United States Patent [19]

Ringler

[11] 3,932,977

[45] Jan. 20, 1976

[54] BALL INFLATING APPARATUS AND METHOD

[76] Inventor: Lloyd H. Ringler, 2500 Greenway Drive, Brownwood, Tex. 76801

[22] Filed: Apr. 19, 1973

[21] Appl. No.: 352,575

[52] U.S. Cl. ..... 53/7; 53/43; 53/88; 53/328; 141/4; 141/95; 141/114; 141/329

[51] Int. Cl.[2] ..... B65B 3/04

[58] Field of Search ..... 141/1, 4, 10, 38, 67, 114, 141/19, 329, 330, 392, 95; 53/7, 43, 88, 268, 328; 150/8

[56] References Cited

UNITED STATES PATENTS

| | | | |
|---|---|---|---|
| 2,533,202 | 12/1950 | Sturtevant | 150/8 |
| 3,699,739 | 10/1972 | Burdwood | 53/88 |

*Primary Examiner*—Houston S. Bell, Jr.
*Attorney, Agent, or Firm*—William Cleland

[57] ABSTRACT

Ball inflating apparatus automatically operable through succession of cycles in each of which a ball inflation needle is momentarily exposed for reception of an end of the same through apertured valve housing of an inflatable ball of stretchable material. In each cycle the ball is also engaged between spaced ball sizing means. Simultaneously with each successive withdrawal of the needle from the valve housing, slide members reciprocated in fixed support base operable to present air sealing device in path of reciprocatable plunger, to urge the sealing device into valve housing aperture for retaining air in the inflated ball. With each withdrawal of inflating needle from fully inflated ball and after insertion of sealing device, full distention of inflated ball actuates ball sizing means to release inflated ball and initiate next successive ball inflation cycle.

18 Claims, 5 Drawing Figures

SV - SOLENOID VALVE
LS - LIMIT SWITCH
T - TIMER
R - RELAY
S - SWITCH
F - FUSED

BALL INFLATING APPARATUS AND METHOD

The present invention relates to an apparatus and method for inflating and sealing round hollow objects, such as for instance plastic play balls.

BACKGROUND OF THE INVENTION

In the manufacture of plastic play balls which are formed of stretchable plastic material, plastic balls of a predetermined size are received generally in heated condition from for instance an oven. The valve housing of each ball is then impaled upon an inflating needle and inflating fluid, such as air, is inserted into the ball to expand the ball to a predetermined finished size, with the heated stretchable wall material of the ball thinning out as the ball expands. A closure plug is then inserted into the valve opening in the ball after withdrawal of the inflating needle to permanently seal the inflating fluid interiorly of the ball, after which the ball is transported to another location for further handling. Many of these operations are manual and the result is increased costs for producing plastic play balls.

SUMMARY OF THE INVENTION

The present invention provides a novel apparatus and method for automatically inflating an expansible ball by means of an inflation needle inserted through an apertured valve housing in the ball while the ball is being held by the apparatus, and then the needle is automatically withdrawn and a plunger member in conjunction with a slide member automatically positions a plug sealing device over the apertured valve housing and the plunger automatically forces the plug into the valve aperture, to permanently seal the inflating fluid interiorly of the ball, after which the apparatus automatically releases the ball in preparation for receiving another ball and performing another inflating operation thereon.

Accordingly, an object of the invention is to provide a novel apparatus for inflating an expansible or stretchable ball, and for inserting a valve sealing means into the valve aperture of the ball after inflation of the latter, for retaining the inflating fluid interiorly of the ball.

A further object of the invention is to provide an apparatus of the above-described type which comprises a relatively stationary supporting base member having therein transversely disposed superimposed top and bottom guide means with top and bottom slide members slidably received in said top and bottom guide means, with an inflation needle movable as a unit with the top slide member and adapted for reciprocation toward and from a fixed point on the supporting member to project freely below the same for impaling of a ball thereon, together with means actuated in synchronism with retraction of the inflation needle for injecting a closure device into the valve aperture for sealing the aperture and thus maintaining the inflated ball in inflated condition.

A still further object of the invention is to provide an apparatus of the aforegoing type wherein the inflating needle means and a plunger means for inserting the closure device, are mounted on the top slide member and include power means for reciprocating said needle and plunger, together with means for sequentially aligning the needle and the plunger means with the aperture in the valve of the ball, and including ball sizing means for gripping the sides of the ball and aiding in maintaining it in position with respect to the needle and plunger means, and which is adapted to automatically release the ball upon completion of the insertion of the closure plug into the valve aperture.

Another object of the invention is to provide a novel and expeditious method for inflating expansible play balls of plastic or the like, and for permanently sealing the valve aperture of the ball, to retain the ball in inflated condition.

Other objects and advantages of the invention will be apparent from the following description taken in conjunction with the accompanying drawings wherein:

DESCRIPTION OF PREFERRED EMBODIMENTS

Figure 1:
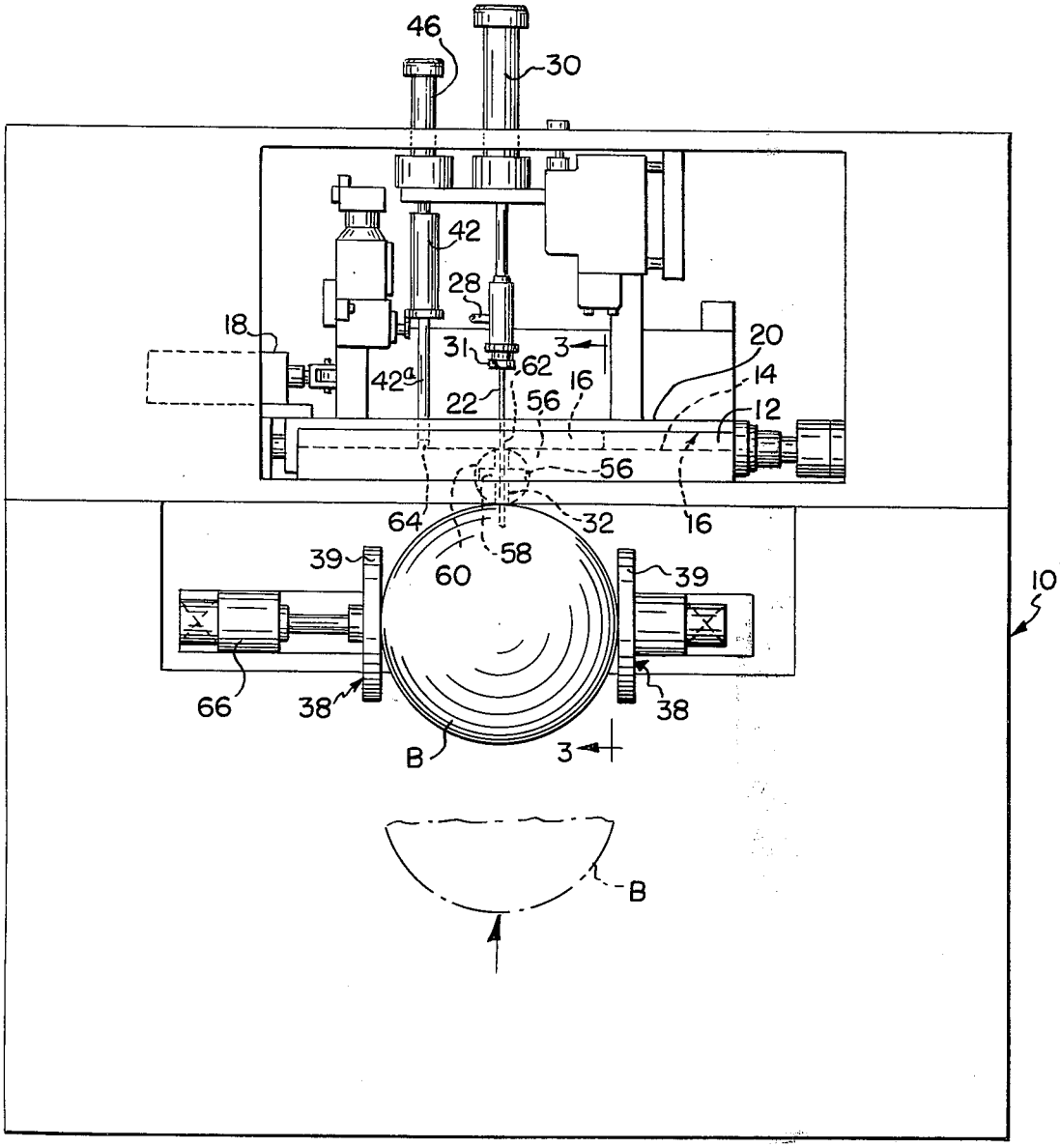
FIG. 1 is a generally diagrammatic, reduced size view of an apparatus embodying the invention, and illustrating a ball member of predetermined size which has been received in heated condition from, for instance, a heating oven, and which has been impaled by the inflating needle of the apparatus, preparatory to inflating the ball.

The apparatus shown in the drawings comprises a base 10 provided with a stationary base support 12 defining an upper slot 14 (FIG. 2) in which is supported a slide member 16. Slide 16 is adapted to be reciprocated or actuated by means of a motor unit 18 operatively coupled thereto, which, when actuated, moves the slide 16 longitudinally in the guide passage or slot 14 from a starting to a stop position and vice versa. Motor unit 18 may be a double acting, preferably fluid powered, motor unit for reciprocation of the slide 16. Guide rails 20 disposed in overlapping guiding coaction with the slide 16 may be provided for aiding in retaining the slide in the guiding passage 14 during actuation of the motor unit 18.

Mounted for longitudinal movement with the slide 16 is a reciprocal, generally vertically oriented inflating needle 22 which includes a central vertically oriented passageway 24 therethrough, with passageway 24 being coupled as by means of coupling 26 to a source of inflating fluid, such as for instance air, and as by means of a preferably flexible conduit 28. A reciprocal, double-acting, preferably fluid powered motor unit 30 is operatively coupled to the inflating needle 22, and as by means of collet 31, for reciprocating the inflating needle in a generally vertical path and into and out of generally vertically extending passage 32 through support 12, and which communicates at its upper end with slide passage 14 and at its lower end with the underside of support 12. The distal end of the inflating needle 22 is preferably sharpened as at 33 (FIG. 2), for ready entry into the aperture 36 of the valve portion 34 (FIGS. 3 and 4) of a ball B of stretchable material.

Figures 3, 4:
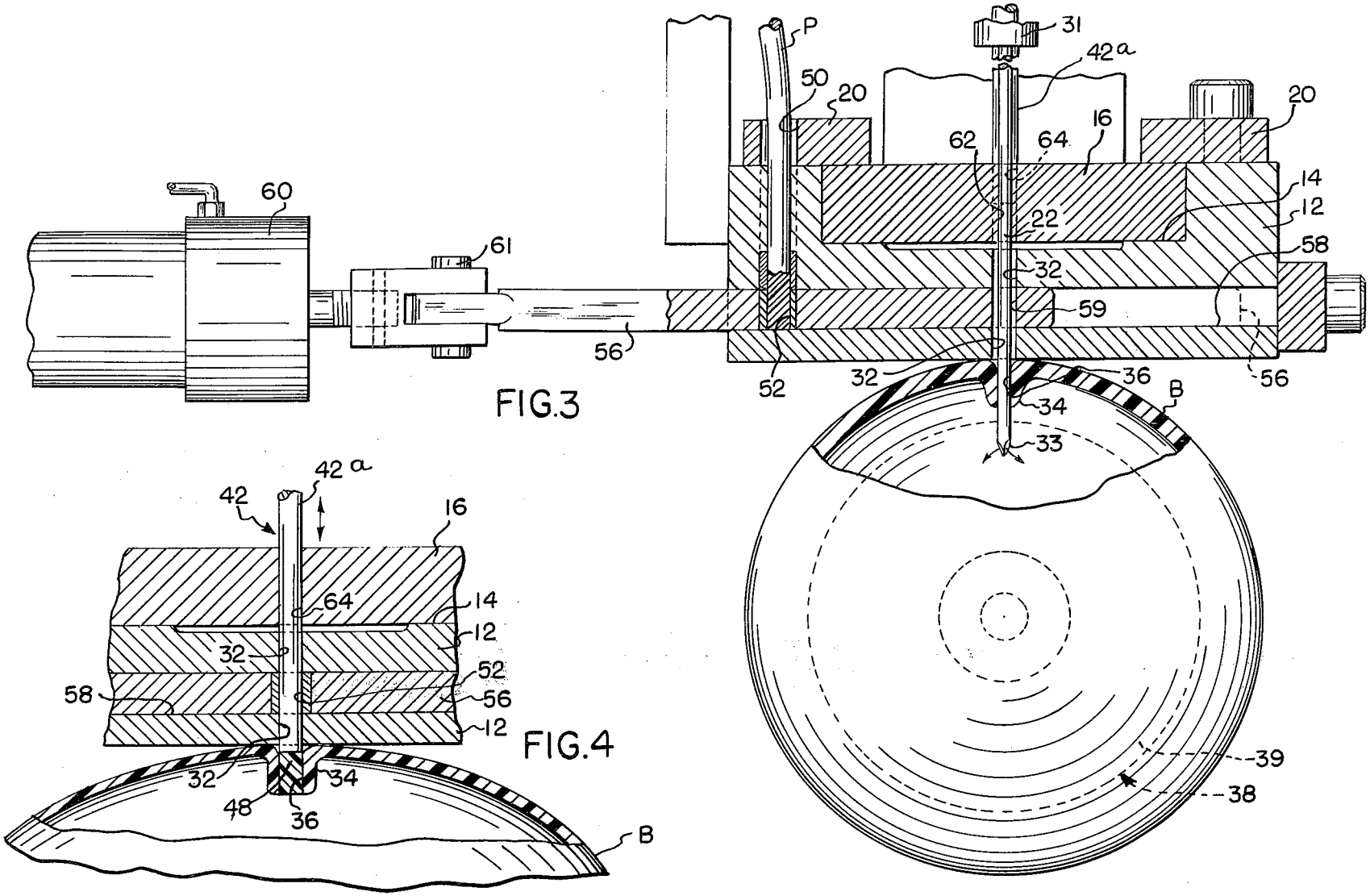
FIG. 3 is an enlarged, fragmentary, partially broken generally diagrammatic view taken generally along the plane of line 3—3 of FIG. 1, showing the inflating needle inserted into the heated ball and commencing the inflation of the ball.
FIG. 4 is a fragmentary, generally diagrammatic, sectional illustration showing the plunger means having forced the closure plug into the valve aperture of the ball, after the ball has been inflated to predetermined size, for sealing the inflating fluid interiorly of the ball, and alos illustrating the thinned out wall material of the ball which was stretched due to the inflating fluid during the expansion of the ball to predetermined size.

Ball B may be formed of plastic such as for instance polyvinyl chloride, which is received in heated condition, and as for instance from a heating oven (not shown) so that the wall material of the ball is readily stretchable when inflating fluid is inserted into the interior of the ball via valve portion or housing 34. The inflating needle 22 is received through the aperture 36 in the valve portion 34 as shown in FIG. 3 and inflating fluid, such as for instance air, is inserted under pressure into the ball to expand the ball to predetermined diameter size. During inflation of the ball, the heated wall material of the ball is thinned out as can be seen by comparing FIGS. 3 and 4. A sealing plug 48 is then inserted into the valve aperture 36 to retain the inflating fluid interiorly of the ball and thus maintain the ball in inflated condition. The above-described process will be hereinafter described in greater detail.

The ball B may be held or maintained in position beneath the support plate 12 by means of sizing and gripping means 38 which in the embodiment illustrated comprise a pair of laterally disposed spring biased plates 39 which are adapted to engage the ball and yieldingly hold the latter in predetermined aligned condition with respect to the aforementioned aperture 32 in the relatively fixed support plate 12.

Mounted for longitudinal movement with slide member 16 and needle mechanism 22 is a plunger member 42, which, in the embodiment illustrated, includes a plunger rod 42a. Member 42 is operatively coupled as by means of coupling 44, to a double acting reciprocal motor unit 46 which is adapted for reciprocating or actuating the plunger member 42 for the purpose of forcing a closure plug 48 (FIG. 4) into the valve aperture 36 of the ball. As can be best seen in FIG. 2, when the plunger rod 42a is aligned with the aperture 32 in the support member 12, such rod is in position to force the underlying closure plug 48 into valve aperture 36, and thus retain the inflating fluid interiorly of the ball to maintain the latter in its inflated condition.

Figure 5:
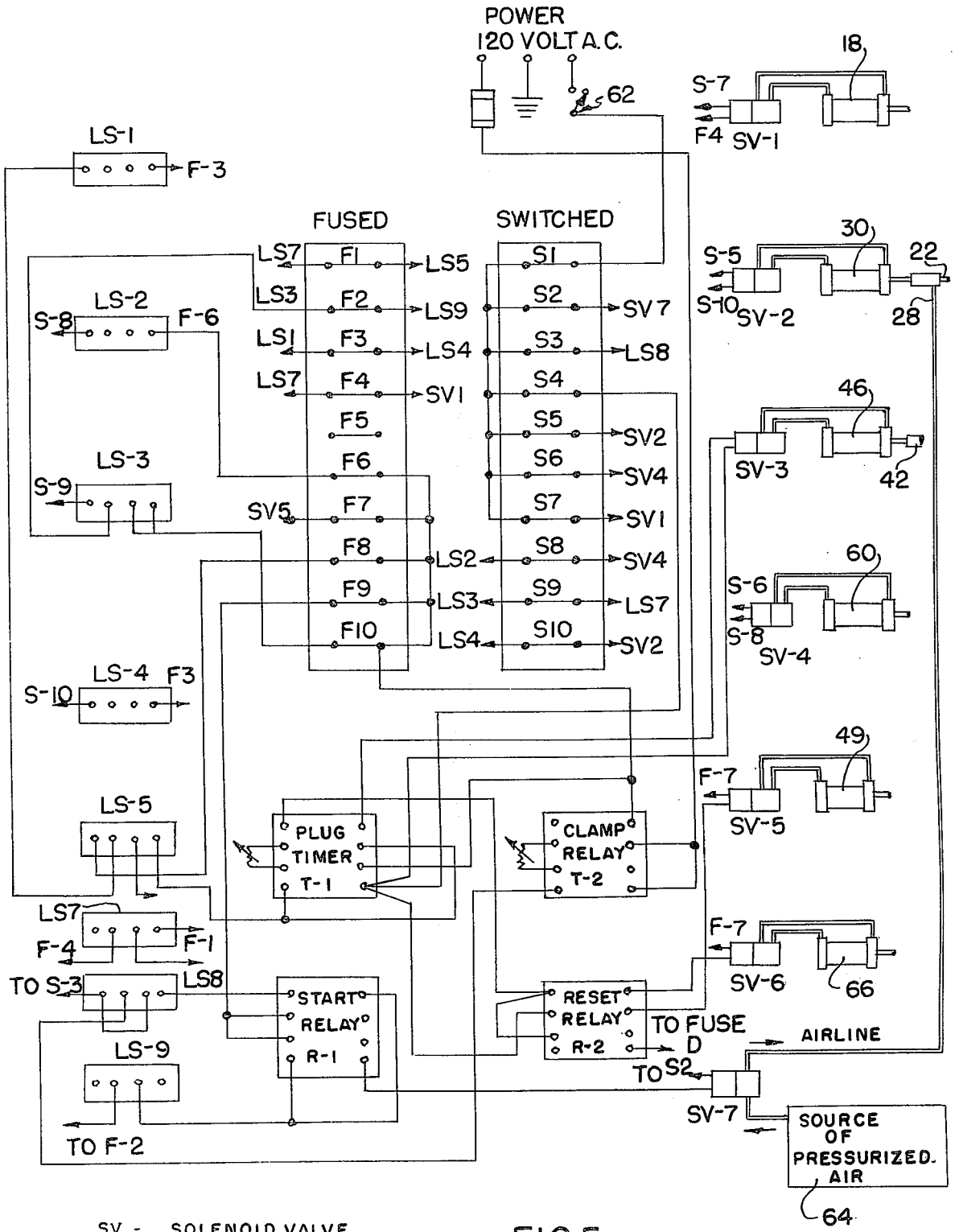
FIG. 5 is a diagrammatic, schematic illustration of fluid and electrical control circuitry which may be utilized to provide for automatic operation of the apparatus.

In the embodiment illustrated, the plug 48 is provided from a supply P (FIG. 3) of plug material in the form of a solid, flexible rod of yieldable plastic or rubber material which could be disposed, for instance, in coil form and power fed as by means of a motor unit 49 (FIG. 5) downwardly through an aperture 50 in the support member 12 and into an opening or recess 52 provided in lower slide member 56.

Lower slide member 56 is operatively mounted for reciprocal movement in a guide slot or passage 58 in support 12. Passage 58 extends lengthwise transverse of upper guide passage 14. As can be best seen in FIG. 3, slide 56 has an opening 59 therein disposed laterally outwardly of aforementioned opening 52 for receiving therethrough the inflating needle 22 during inflation of the ball B, and when opening 59 is axially aligned with opening 32 through the support 12. As can be best seen in FIG. 3, lower slide 56 extends lengthwise transversely of upper slide 16 at an angle of approximately 90° with respect to the lengthwise extension of the upper slide 16. Lower slide 56 is adapted to be reciprocated lengthwise thereof and as by means of a motor unit 60 operatively coupled thereto as at 61 (FIG. 3) with motor unit 60 in the embodiment illustrated being a double acting reciprocal unit powered by any suitable means, such as for instance air.

When motor unit 18 shifts the upper slide member 16 and associated inflation needle 22 and plunger 42 longitudinally and toward the right of the position illustrated in FIG. 1, both motor units 30 and 46 are in retracted condition with the lower ends of both the needle 22 and plunger rod 42a being disposed in a respective opening 62 and 64, which are laterally disposed and extend vertically through the top slide 16. In such finalized shifted position, opening 64 in the top slide 16 is disposed above and axially aligned with opening 32 in the support 12. Moreover, the lower slide is also shifted from the position shown in FIG. 3 to the right, to axially align opening 52 in the lower slide with opening 32 in the support 12. During such shifting movement of the lower slide, the latter shears off a plug 48 of the flexible plastic rod from the end of the latter which extends into opening 52. The lower slide carries the plug of material with it and upon positioning of opening 52 in alignment with opening 32, the plug 48 is disposed in alignment with opening 64 in the upper slide and in alignment with the plunger rod 42a of plunger rod 42. Actuation of motor unit 46 is operable to cause the plunger rod 42a to extend into opening 32 and engage the closure plug 48, for ramming or forcing the plug 48 into the valve aperture 36 to seal the valve aperture, thus retaining the ball in inflated condition.

Since the inflated ball is held by sizing and gripping mechanism 38 against the underside of the stationary support 12 and in alignment with the opening 32 therethrough, the air interiorly of the ball has no opportunity to escape, and when the plug 48 is forced downwardly upon actuation of the motor unit 46, the closure plug positively seals the valve 34 of the ball.

Figure 2:
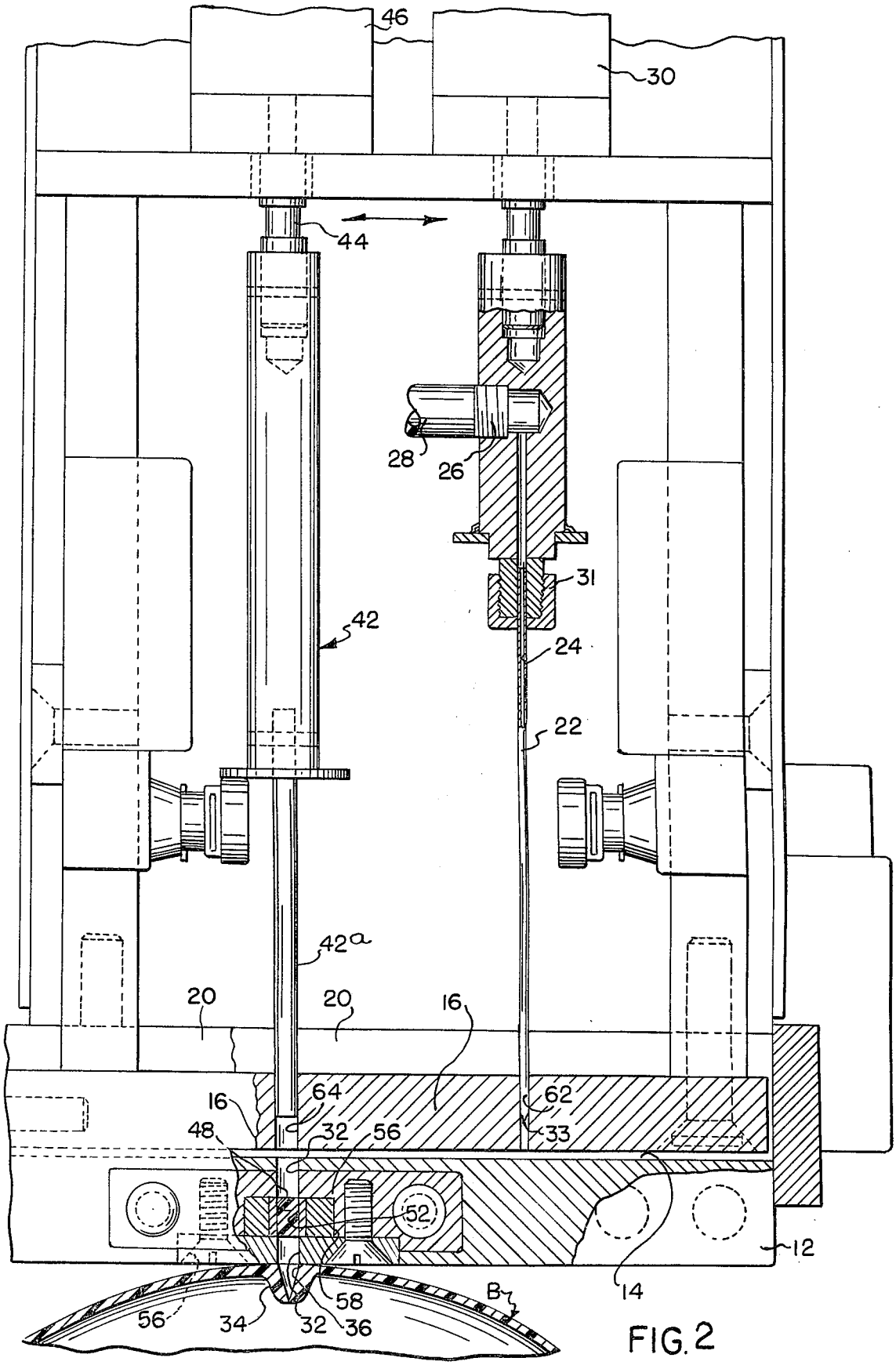
FIG. 2 is an enlarged, partially sectional, generally diagrammatic, fragmentary view of the needle inflating means and the plunger means for forcing the sealing plug into the valve aperture of the inflated ball, with the sealing plug having been shifted by the lower slide member from a supply thereof into alignment with the overlying plunger, for subsequent movement into the valve aperture upon downward actuation of the plunger.

The plunger rod 42a is then drawn upwardly from opening 32 in the support 12 and back to the position shown in FIG. 2 wherein its lower end is disposed intermediate the ends of opening 64 in the top slide, whereupon motor unit 60 is actuated to shift the lower slide 56 back to its starting position, and the supply rod P is activated to force the end thereof into recess 52 in the lower slide 56 to provide for another closure plug and motor unit 18 is reactuated to shift the upper slide 16 back to its starting position, for initiation of another inflation cycle of the apparatus.

Automatic operation of the apparatus may be as follows:

In an initial starting position of the ball inflating apparatus as shown for instance in FIG. 1, for a continuous succession of ball inflating operations, the inflating needle 22 initially projects a predetermined extent below the underside of fixed support 12 as shown in FIGS. 1 and 3, so that an inflatable article, such as the plastic ball B which may have been previously heated, can be manually presented upwardly between the laterally spaced, laterally yieldable ball supporting and sizing discs 39.

The projecting end 33 of the inflating needle is received through the valve aperture 36 of the integral valve housing 34 in the spherical wall of the ball. At the same time, in this initial starting position of the apparatus, the lower slide plate 56 has the lower end of the continuous rod P of plug material presented within the recess or opening 52 in the slide plate 56 and as shown in FIG. 3. In this condition, the ball B is capable of being supported solely by the friction between the inflating needle and the confronting surfaces of the valve housing of the ball, during the ball inflating operation. It will be understood however that spring biased discs 39 also exert a certain degree of holding force on the sides of the ball.

Manual actuation of switch 62 by a workman applies power to the circuitry. Insertion of the deflated ball B onto the needle 22 and between the laterally disposed plates 39 automatically trips limit switch LS9 (FIG. 5) which through start relay R1, activates solenoid valve SV7 to cause inflation air to be supplied from a source 64 of pressurized air and via for instance line 28, to the central passageway 24 through the needle, thus causing the pressurized air to pass via ball valve 34, into the ball and to commence inflation thereof.

As the ball B expands to its predetermined finalized diameter size, the laterally spaced, biased discs 39 are forced apart by the expanding ball, whereupon a limit switch LS7 is activated for shutting off solenoid valve SV7 and stopping the supply of pressurized air via needle 22 into the ball, and at the same time activating solenoid valve SV2 so as to cause actuation of motor unit 30 (FIG. 1) to cause the needle 22 to be raised upwardly from the opening 32 in the support base 12, until the distal end 33 thereof is positioned within opening 62 in the upper slide 16, and as shown in FIG. 2.

When the needle is retracted to its up position, it actuates a limit switch LS2 causing actuation of solenoid valve SV1 thereby actuating motor unit 18 to cause shifting of the upper slide 16 and to which are coupled the needle and the plunger member 42, from the home or start position toward the right to a given stop position, thereby placing the plunger rod 42a of the plunger mechanism in axial alignment with opening 32 in the support base 12, and in overlying relation to the ball.

When the upper slide 16 has completed its shifting movement, the slide causes actuation of limit switch LS5 which in turn activates the solenoid valve SV4 controlling motor unit 60, to cause shifting of the lower slide 56 from its position as illustrated in FIG. 3, toward the right thereof and to a given stop position wherein the plug cavity 52 which contains the plug 48 of material cut off from the end of the supply rod P, is disposed in axial alignment with overlying opening 64 in the upper slide 16 and in axial alignment with the opening 32 in support base 12.

Upon completion of the shifting movement of lower slide 56, the latter actuates a limit switch LS4 which causes actuation of solenoid valve SV3 controlling motor unit 46, which causes the plunger member 42 to move downwardly, thus causing the plunger rod 42a thereof to move into aligned opening 32 in support base 12, and push the plastic plug 48 of material in cavity 52 in the lower slide, through aligned opening 32 into the valve housing 34 in the ball, thus sealing the inflating fluid interiorly of the ball.

Activation of LS4 also causes activation of switch LS8 and timer T1. When the timer T1 times out, the solenoid valve SV6 controlling motor unit 66 is actuated to cause motor unit 66 to move the associated disc 39 away from the opposing disc and return, whereby the inflated and plugged ball drops by gravity onto conveying mechanism for moving the ball away from the apparatus. Moreover, timing out of T1 causes the solenoid valve SV3 to be actuated so as to actuate the motor unit 46 to return the plunger mechanism 42 to raised position, wherein the lower end of the plunger rod 42a is once again disposed in the opening 64 in upper slide 16.

When the plunger has been returned to the up position, a limit switch LS5 is actuated by the plunger which causes actuation of solenoid valve SV4 to cause actuation of motor unit 60, thereby moving the lower slide 56 back to its starting or home position as shown in FIG. 3, whereupon the end of the rod or plug material is fed or urged by continuous feed motor 49 into the cavity or opening 52 in the lower slide.

Upon reaching starting or home position, lower slide 56 actuates limit switch LS1 which causes actuation of solenoid valve SV1 to actuate motor unit 18, thus causing shifting of the upper slide 16 back to starting position, and wherein the opening 62 therein is once again axially aligned with the opening 32 in the support base 12. When slide 16 reaches its home or starting position, a limit switch LS3 is actuated which causes actuation of the solenoid valve SV2 causing the motor unit 30 to extend the needle 22 down through aligned opening 32 in the support base 12 and to extend below the support base. At this time all of the mechanisms are in starting or home position, ready for repeating of the cycle.

While the supply of plug material P has been illustrated as being a continuous rod of flexible plastic material, it will be understood that other types of supply of plug material could be provided for the apparatus, such as for instance a supply of precut or preformed individual plugs which could be sequentially fed down into the recess opening 52 in lower slide 56, for subsequent shifting with the slide into aligned relation with opening 32 and insertion into the valve housing of an inflated ball.

From the foregoing description and accompanying drawings it will be seen that the invention provides a novel ball inflating apparatus and method which is automatically operable through a succession of cycles, and wherein the apparatus comprises a relatively fixed supportive member having therein transversely disposed superimposed top and bottom guide means, with top and bottom slide members slidably received in the guide means, and with an inflation needle and plug injection means coupled to the top slide member for movement therewith, for sequentially inflating an associated expandable ball to a predetermined diameter size, and then inserting a plug into the valve aperture of the ball for retaining the ball in inflated condition, with the plug being supplied into coaction with the ball by shifting movement of one of the slide members.

The terms and expressions which have been used are used as terms of description and not of limitation, and there is no intention in the use of such terms and expressions of excluding any equivalents of any of the features shown or described or portions thereof, and it is recognized that various modifications are possible within the scope of the invention claimed.

What is claimed is:

1. In an apparatus for automatic inflation of inflatable balls of type each having an integral elastic valve housing apertured for inward yielding reception of a closure adapted to retain inflating fluid in the balls, comprising, top and bottom guide means, top and bottom slide members slidably received in said top and bottom guide means respectively, an inflation needle having a distal end and coacting with said top slide member to be reciprocated toward and from a fixed position on said support member to project the distal end of the needle freely of the support member, ball supporting means in association with said support member and to align the valve housing aperture with said needle, means for reciprocating said needle to and from reception of said distal end thereof into the apertured valve housing of a ball for inflating the ball to a predetermined size, and closure applying means operable in synchronism with retraction of the reciprocated inflation needle to inject a said closure into yielding reception thereof within the elastic ball valve housing aperture for maintaining the ball in inflated condition.

2. Apparatus in accordance with claim 1, said ball supporting means including ball sizing and gripping means located in relation to said fixed position on the support member for gripping coaction with the ball, and means adapted for coaction with said ball sizing and gripping means for operation in response to expansion of the ball to predetermined expanded diameter to cause retraction of said needle and actuation of said closure applying means.

3. Apparatus in accordance with claim 1 wherein said inflation needle and said closure applying means are carried by said top slide member for shifting movement therewith.

4. Apparatus in accordance with claim 2 wherein said sizing and gripping means includes laterally disposed disc members adapted to engage the sides of the ball, and means for biasing the disc members toward one another.

5. Apparatus in accordance with claim 1 wherein said support member comprises a generally vertically extending opening therethrough communicating at one end thereof with said top guide means and at the other end thereof with the exterior underside of said support member, said top slide member having a pair of laterally spaced generally vertically extending openings provided therethrough, said inflation needle extending into one of the last mentioned vertically extending openings and said closure applying means extending into the other of the same, and said last mentioned vertically extending openings being adapted to be sequentially aligned with the first mentioned vertically extending opening for sequential movement of first the needle and then the closure applying means through said support member opening for coaction with the ball.

6. Apparatus in accordance with claim 1 including reciprocal fluid powered motor means coacting with said inflation needle and with said closure applying means for reciprocating the same.

7. Apparatus in accordance with claim 1 wherein said closure applying means comprises a plunger member including a reciprocal plunger rod extending parallel to said needle, said rod being operable for engaging a said closure and forcing the latter into the valve housing aperture.

8. Apparatus in accordance with claim 5 including a motor unit operatively coupled to said top slide member for shifting the latter with respect to said opening in said support member and with respect to said bottom slide member, to sequentially align the needle and the closure applying means with the support member opening, said bottom slide member having a generally vertical opening therethrough adapted for receiving a said closure applying means in the starting position of said bottom slide member and operable to locate said bottom slide member opening with said other of said last mentioned openings in a shifted stop position of said bottom slide member.

9. Apparatus in accordance with claim 2 including motor means coacting with said sizing and gripping means for actuating said sizing and gripping means after injection of said closure applying means into the valve housing for permitting the ball to drop by gravity from said sizing and gripping means.

10. Apparatus in accordance with claim 1 including control means for controlling automatic operation of said apparatus through a predetermined cycle of operation, said control means including means responsive to insertion of a ball into coaction with the distal end of said needle to initiate flow of inflating fluid through the needle and into the ball to inflate the latter.

11. Apparatus in accordance with claim 9 including control means for controlling automatic operation of said apparatus through a predetermined cycle of operation, said closure applying means including reciprocal plunger means, said control means including timer means for causing the retraction of said reciprocal plunger means after insertion of the closure device into the valve housing aperture and causing actaution of said motor means coacting with said sizing and gripping means.

12. Apparatus in accordance with claim 2 wherein said bottom slide member includes aperture means adapted to receive therein a said closure whereby said bottom slide member upon shifting movement thereof from said fixed position to a predetermined stop position, locates the closure in overlying relation with the valve housing aperture for subsequent insertion therein by said closure applying means.

13. Apparatus in accordance with claim 12 wherein said means for supplying said closures includes a rod of plastic material the end of which is adapted to be received within said aperture means in said bottom slide member in the start position of the latter, said bottom slide member being operative to automatically shear the end of the rod from the remainder of the rod during shifting movement of said bottom slide member from said start position toward said stop position, thereby to form a closure plug for subsequent insertion into the valve housing aperture of the ball by said closure applying means.

14. Apparatus for inflating balls having apertured valve housings comprising, a supporting base provided with a generally horizontally extending first guide passage and a second generally horizontal guide passage extending generally transversely of said first guide passage, said base having generally vertically extending passageway means therethrough communicating with said first and second guide passages and with the exterior of said base, first and second guide elements mounted in said first and second guide passages respectively to be slidable therein from respective start positions toward given stop positions and return of said slide elements back to said start positions, said slide elements being provided with generally vertical apertures alignable with each other and with the first mentioned passageway means in said positions, feeding means for feeding ball valve closure means into one of said apertures in said second slide element while said first and second slide elements are in certain of said positions thereof, said first slide element carrying a reciprocal inflation element and a reciprocal closure inserting element laterally spaced with respect to one another, motor means for reciprocating said first slide element to alternately align said inflation element and then said inserting element with said first mentioned passageway means, and vice versa, means to momentarily operate said inflation element in said ball to inflate the same and then to move said inflation element generally vertically out of said ball whereupon said motor means shifts said first slide element to its said stop position wherein said closure inserting element is aligned with said first passageway means, and means to cause shifting of said second slide element to a position wherein said one aperture thereof and the associated valve closure means therein are in alignment with said first mentioned passageway means, and means for causing reciprocation of said closure inserting element to cause injection of said valve closure means into the valve housing aperture of the ball for maintaining the ball in inflated condition, and means for causing the last mentioned shifting means to return said second slide element to said start position and for causing said motor means to return said first slide element to said start position.

15. A method for inflating an expandable ball of type having an integral valve housing apertured for inward yielding reception of a closure adapted to retain inflating fluid in the ball comprising, impaling the apertured valve housing of the ball on a reciprocal inflation element and engaging the ball from the sides thereof for retaining it with said valve housing in predetermined position on the inflation element, inflating the ball to a predetermined expanded diameter size by means of the said inflation element, withdrawing the inflation element from the ball valve housing and shifting said withdrawn element laterally to non-interfering relation with respect to the apertured valve housing and positioning a valve closure over the apertured valve housing of the inflated ball, and forcing the valve closure into the apertured valve housing while retaining the ball with the valve housing maintained in said predetermined position by lateral gripping of the sides of the ball and thereby to seal the valve housing aperture so as to retain the inflating fluid interiorly of the inflated ball, and then terminating said gripping engagement of the ball from the sides thereof to permit movement of the ball away from the gripping means.

16. A method in accordance with claim 15 including the step of cutting a valve closure from a continuous supply of valve closure material and positioning the cut valve closure over the valve aperture in a single laterally shifting operation moving transversely of the first mentioned shifting movement of said inflation element.

17. A method in accordance with claim 15 wherein the ball is impaled upon the inflation element by moving the ball upwardly into coacting relation with the inflation element while the latter extends downwardly.

18. A method in accordance with claim 15 including the step of heating the ball prior to inflating it so that the defining wall thereof can be readily stretched during inflation of the ball to permit predetermined enlargement of the ball by the inflating fluid.

* * * * *